US007503329B2

(12) United States Patent
Lenart et al.

(10) Patent No.: US 7,503,329 B2
(45) Date of Patent: Mar. 17, 2009

(54) CIGAR CUTTER

(76) Inventors: Ferenc Lenart, 25622 Califia Dr., Laguna Hills, CA (US) 92653; Steven L. Thorpe, 34241 Camino El Molino, Capistrano Beach, CA (US) 92646

( * ) Notice: Subject to any disclaimer, the term of this patent is extended or adjusted under 35 U.S.C. 154(b) by 0 days.

(21) Appl. No.: 10/222,356

(22) Filed: Aug. 16, 2002

(65) Prior Publication Data

US 2004/0031154 A1 Feb. 19, 2004

(51) Int. Cl.
*A24C 5/28* (2006.01)
*A24F 13/24* (2006.01)

(52) U.S. Cl. ..... 131/254; 30/109

(58) Field of Classification Search ..... 30/109, 30/110, 113; 131/254, 252, 253, 242, 255; D27/195

See application file for complete search history.

(56) References Cited

U.S. PATENT DOCUMENTS 672,157 A * 4/1901 Willard ..... 30/112
894,858 A * 8/1908 Singley ..... 131/254
1,628,570 A * 5/1927 Anderson ..... 131/254
1,730,438 A * 10/1929 Schulz ..... 30/110
1,911,271 A * 5/1933 Englen ..... 131/254
3,903,598 A * 9/1975 Lefebvre ..... 30/112
5,345,952 A * 9/1994 Nielander ..... 131/248
5,771,581 A * 6/1998 Smith ..... 30/111
5,836,318 A * 11/1998 Adams ..... 131/253
6,023,845 A * 2/2000 Moore ..... 30/110
7,299,807 B2 * 11/2007 Spatafora et al. ..... 131/253

FOREIGN PATENT DOCUMENTS

GB 189320260 A * 0/1894

* cited by examiner

*Primary Examiner*—Kenneth E. Peterson
*Assistant Examiner*—Sean Michalski

(57) ABSTRACT

A cigar cutter has a housing, a receiving well provided in the housing for receiving one end of a cigar, a motor retained inside the housing, and a cutter carried on the motor and extending into the receiving well. The cutter has a lower portion and a conical upper tip, with three cutting surfaces provided on the conical upper tip.

5 Claims, 4 Drawing Sheets

CIGAR CUTTER

BACKGROUND OF THE INVENTION

1. Field of the Invention

The present invention relates to a cigar cutter and, in particular, to a motorized cigar cutter.

2. Description of the Prior Art

There are two types of cigar cutters that commonly available in the marketplace. A first type is commonly known as a blade or guillotine type of cigar cutter, which has a straight edge blade (like a razor blade) that slices off one end of a cigar. A second type is commonly known as a punch type of cigar cutter, which is like a needle that is inserted into the end of a cigar. A variation of this is a hollow cylinder that is punched into the cigar and then twisted to remove the core. Both types of cigar cutters are manual cutters that require the user to position the cigar in the cutter before manipulating the cutter to cut the cigar.

These conventional cigar cutters suffer from a number of drawbacks. First, these manually-operated cigar cutters often cause tears in the wrapper of the cigar. Second, the cuts provided by these conventional cigar cutters result in a minimal surface area of the cut. In this regard, a greater surface area will promote an easier draw of smoke. Third, blade-type cutters often become dull with extended use. Fourth, punch-type cutters provide a small surface area for the cut where tobacco tar and by-products can often build up, thereby creating a bitter taste to the smoker.

Thus, there remains a need for an improved cigar cutter which overcomes the problems described above.

SUMMARY OF THE DISCLOSURE

It is an object of the present invention to provide a cigar cutter that minimizes tears in the cigar wrapper.

It is another object of the present invention to provide a cigar cutter that increases the surface area of the cut.

It is yet another object of the present invention to provide a cigar cutter that is motorized and does not require manual manipulation of the cutting action.

In order to accomplish the objects of the present invention, the present invention provides a cigar cutter having a housing, a receiving well provided in the housing for receiving one end of a cigar, a motor retained inside the housing, and a cutter carried on the motor and extending into the receiving well. The cutter has a lower portion and a conical upper tip, with three cutting surfaces provided on the conical upper tip.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

The present invention provides a motorized cigar cutter that minimizes tears in the cigar wrapper. In addition, the cigar cutter of the present invention provides a novel blade that increases the surface area of the cut on the cigar.

Figure 1:
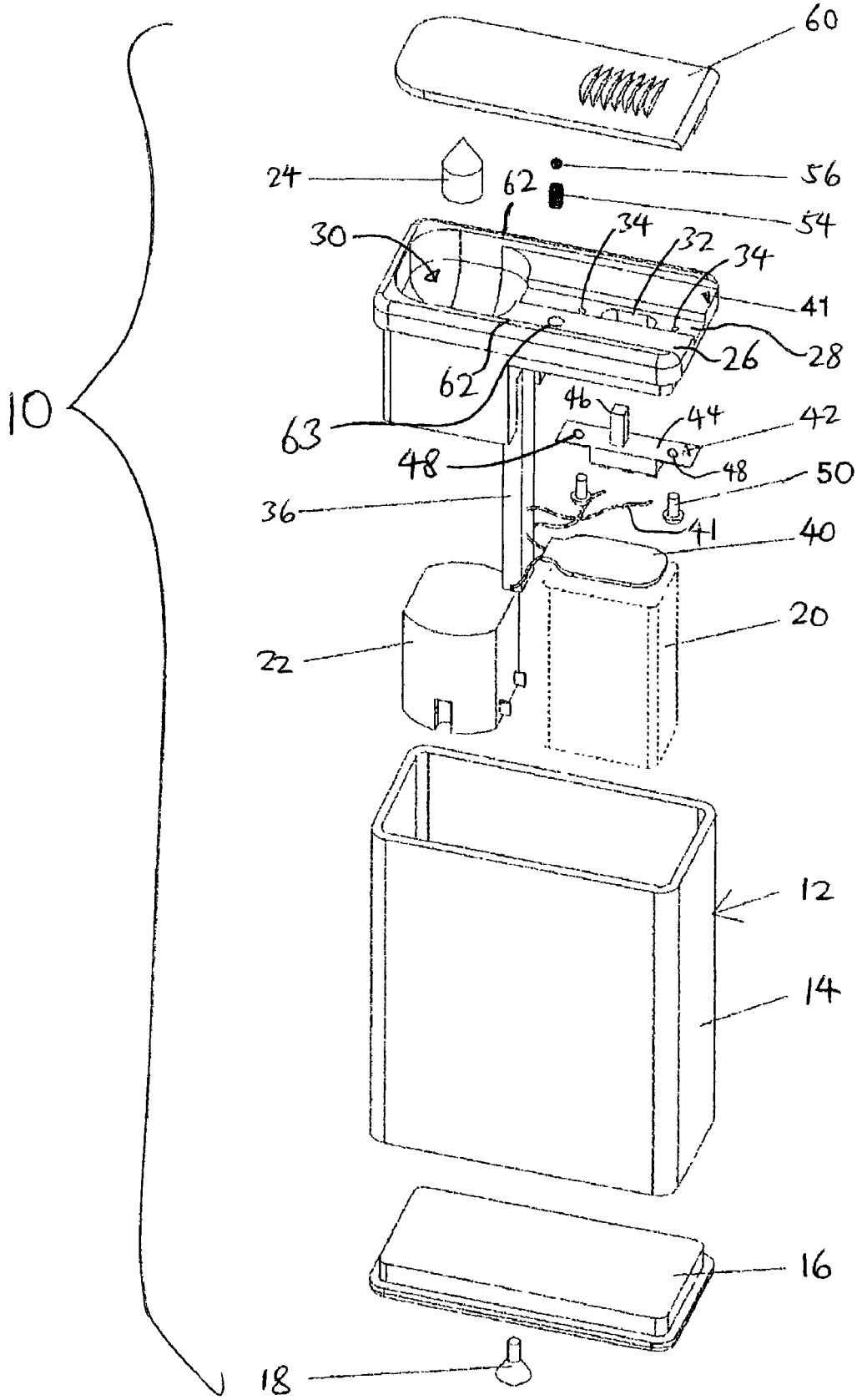
FIG. 1 is an exploded perspective view of a cigar cutter according to one embodiment of the present invention.
Figure 2:
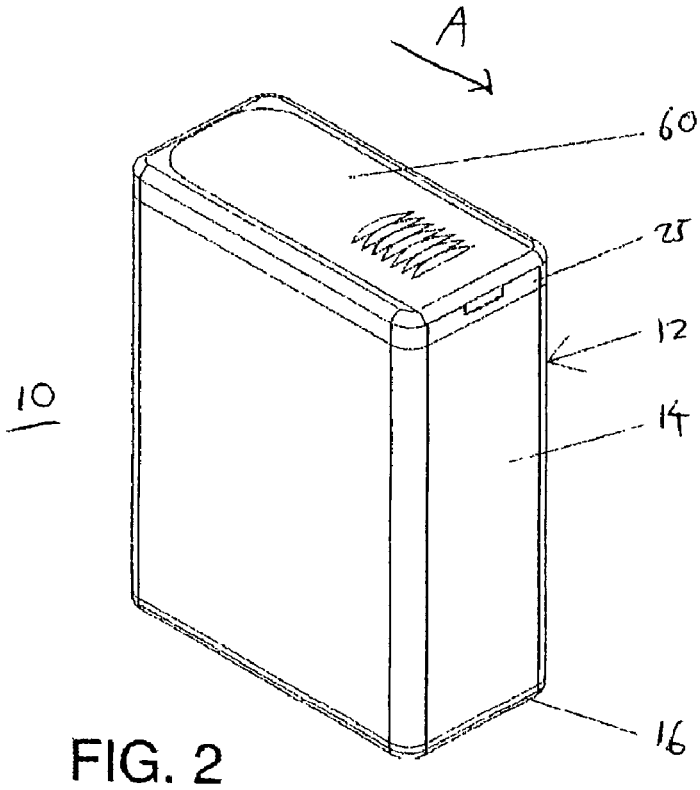
FIG. 2 is a perspective view of the cigar cutter of FIG. 1 shown in its assembled form.
Figure 3:
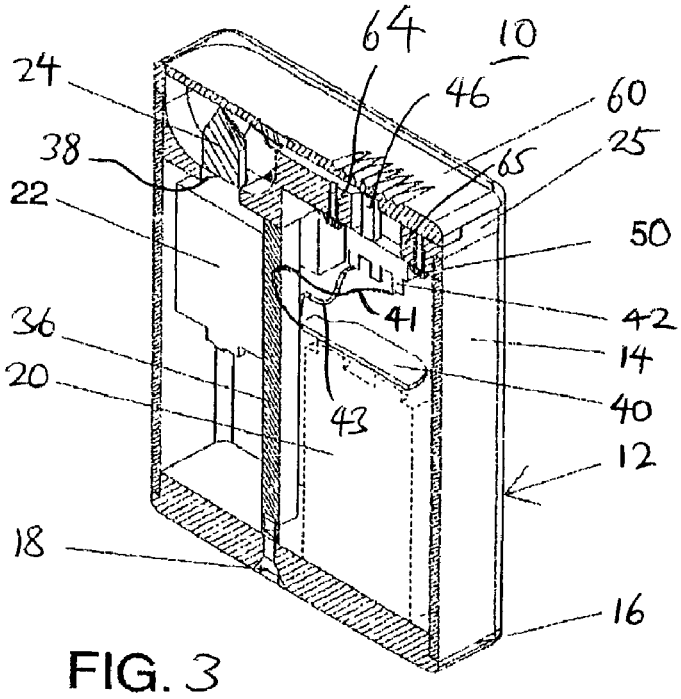
FIG. 3 is a perspective cross-sectional view of the cigar cutter of FIG. 1.

FIGS. 1-3 illustrate one embodiment of a cigar cutter 10 according to the present invention. The cigar cutter 10 has a housing 12 that can have a four-sided (e.g., rectangular) configuration with four walls 14. The housing includes a bottom wall 16 that can be secured to the bottom of a stabilizing internal bar 36 by a screw 18 (see FIG. 3). The housing 12 houses the various components of the cigar cutter 10, including a power source 20, a motor 22, a cutting blade or bit 24, and a cutting platform 25.

The cutting platform 25 has a plate 26 with a trough 28 extending longitudinally along the plate 26, and terminating at one end into a generally concave receiving well 30. An opening 32 is provided at about the center of the trough 28, and two threaded holes 34 are provided on either side of the opening 32 in the trough 28. A stabilizing internal bar 36 extends vertically downwardly from the plate 26 adjacent to the location where the trough 28 transitions into the receiving well 30. A blade opening 38 is provided at about the center of the bottom of the receiving well 30.

Figure 9:
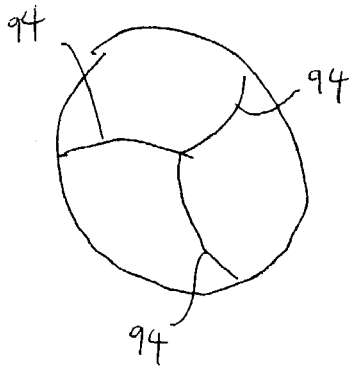
FIG. 9 is a top plan view of the cutting blade of FIG. 8.
Figure 8:
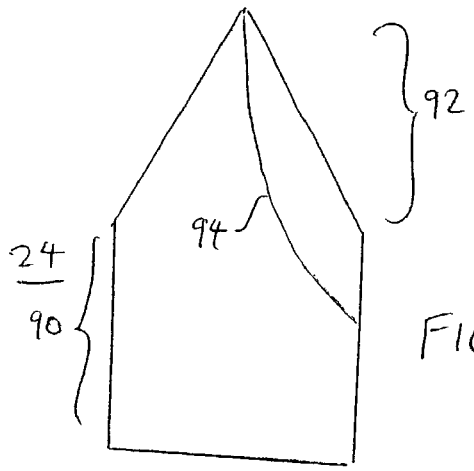
FIG. 8 is a side plan view of the cutting blade that can be used with the cigar cutter of FIG. 1.

The motor 22 can be any conventional rotary 1200 rpm motor, and carries the cutting blade 24 at its upper end. Referring to FIGS. 8 and 9, the cutting blade 24 can be embodied in the form of a conical bit having a generally cylindrical lower portion 90 and a conical or cone-shaped upper tip 92. In one non-limiting embodiment, the cutting blade 24 can be what is known in the art as a "dovetail" bit or cutter which is normally made of stainless steel. The cutting blade 24 has three curved cutting surfaces 94 that are hollowed out from the upper tip 92 to create three areas on the upper tip 92 that can cut the cigar. The motor 22 is retained in the housing 12 on one side of the bar 36 (e.g., by wedging the motor 22 between the housing 12 and the bar 36). The cutting blade 24 extends through the blade opening 38 in the receiving well 30, and is normally positioned inside the receiving well 30.

The power source 20 can be a conventional battery (or plurality of batteries), and is retained in the housing 12 on the other side of the bar 36 opposite the motor 22 (e.g., by wedging the power source 20 between the housing 12 and the bar 36). A connection cap 40 is electrically coupled to the power source 20. The connection cap 40 is also electrically coupled via a wire 41 to a power switch 42 (see also FIG. 7). Another wire 43 connects the power switch 42 to the motor 22. In one embodiment, the connection cap 40 can be a standard nine-volt battery cap, which has a positive pole and a negative pole. The power swtich 42 has a plate 44 with a button 46 provided on the upper surface of the plate 44. A pair of spaced-apart holes 48 are provided on the plate 44, with each hole 48 receiving a corresponding screw 50. Each screw 50 extends through the corresponding hole 48 in the plate 44 and a correspondingly aligned hole 34 in the cutting platform 25, so as to secure the switch 42 to the bottom of the cutting platform 25. When the switch 42 is secured to the bottom of the cutting platform 25, the button 46 extends through the opening 32 in the cutting platform 25. A spring 54 and a ball bearing 56 seated on top of the spring 54 are positioned inside a depression 63. The spring 54 provides a normal bias against the bearing 56 towards a sliding cover 60.

The power source 20 can be replaced by removing the bottom wall 16 from the housing 12 by removing the screw 18. If embodied in the form of a battery, the power source 20 can then be removed from the bottom of the housing 12 by pulling the battery from the confines of the housing 12 and detaching the connection cap 40 from the battery. A new battery can then be attached to the connection cap 40 and re-inserted into the housing 12, and the bottom wall 16 screwed back to the housing 12.

Figure 7:
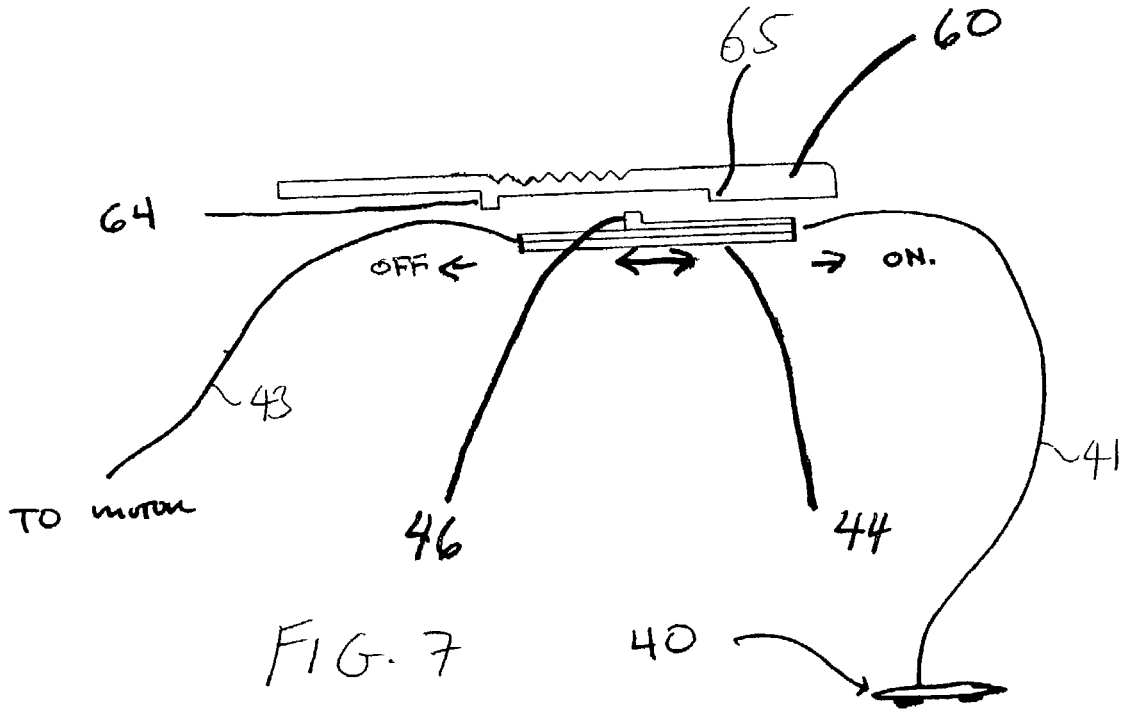
FIG. 7 is an isolated side plan view illustrating the relationship between the sliding cover and the power switch.

A sliding cover 60 is provided for sliding motion on top of the cutting platform 25. The top edges 62 of the cutting platform 25 form a rail track along which the cover 60 can slide. The cover 60 cooperates with the button 46 to function as an ON/OFF switch. The bottom surface of the cover 60 has two notches 64 and 65 extending downwardly therefrom, as shown in FIGS. 3 and 7, in a manner to define an open space 67 therebetween. The button 46 is positioned at all times inside this space 67, with the notches 64 and 65 acting as stop members to define the limit of movement for the button 46, to prevent the cover 60 from being slid off the platform 25. The button 46 travels back and forth between the notches 64 and 65 to switch on and off the motor 22.

Figure 4:
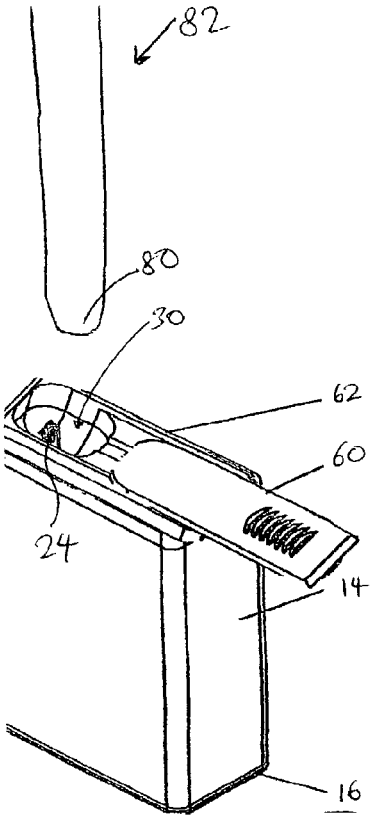
FIG. 4 is a perspective view of the cigar cutter of FIG. 1 prior to the cutting operation.
Figure 5:
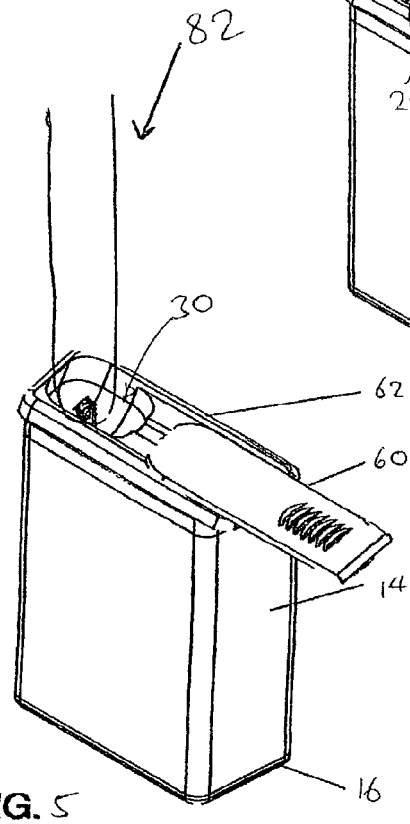
FIG. 5 is a perspective view of the cigar cutter of FIG. 1 illustrating a cigar positioned in the well during the cutting operation.
Figure 6:
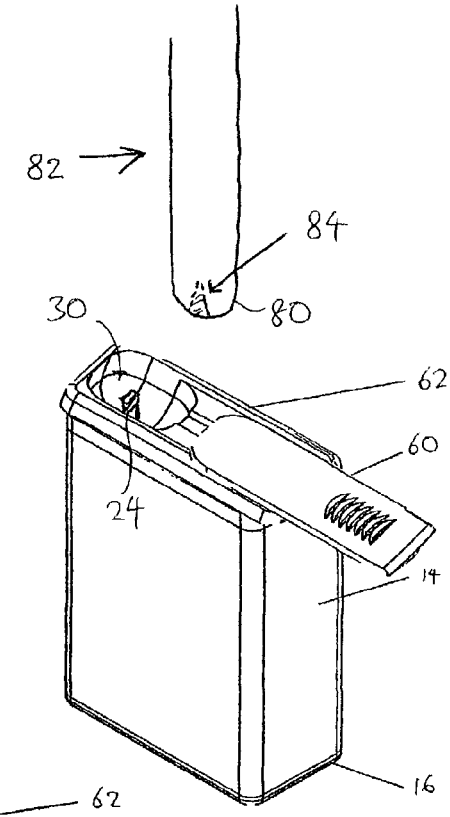
FIG. 6 is a perspective view of the cigar cutter of FIG. 1 after the cutting operation has been completed.

FIGS. 4-6 illustrate the operation of the cigar cutter 10. When the cigar cutter 10 is not in use, the cover 60 completely covers the cutting platform 25 and the receiving well 30, as shown in FIGS. 2 and 3. When in this non-use position, the button 46 is positioned inside the space 67 adjacent the notch 64 of the cover 60, so that the switch 42 is turned off by keeping the electrical circuit open.

To use the cigar cutter 10, the user slides the cover 60 outwardly along the cutting platform 25 in the direction of arrow A to expose the receiving well 30, as shown in FIG. 4. As the cover 60 slides along the rail track defined by the top edges 62 of the cutting platform 25, the cover 60 and its notch 64 will push the button 46 in the direction of arrow A, so that its switch 42 will also in the direction of arrow A. When the button 46 contacts the notch 65, the switch 42 will close the electrical circuit to cause the motor 22 to turn on. As the motor 22 turns on, the cutting blade 24 rotates. At this time, the user inserts one end 80 of a cigar 82 in a top-down fashion into the receiving well 30, where the rotating cutting blade 24 will begin to cut the end 80 of the cigar 82, as shown in FIG. 5. If the cutting blade 24 of FIGS. 8 and 9 is used, a conical cut 84 will be made in the end 80 of the cigar 82. The user removes the cigar 82 from the receiving well 30 when he or she believes that the cut has been completed. A conical cut 84 will have been formed in the end 80 of the cigar 82, as shown in FIG. 6.

When the user wishes to turn off the motor 22, the user slides the cover 60 back towards the receiving well 30 in a direction opposite to the direction of arrow A to cover the receiving well 30. As the cover 60 is slid in a direction opposite to the direction of arrow A, the notch 65 will push the button 46 in a direction opposite the direction of arrow A, thereby opening the electrical circuit to cause the motor 22 to turn off. The user can then continue to slide the cover 60 in the direction opposite to the direction of arrow A until the cover 60 completely covers the receiving well 30.

Thus, the blade 24 creates a conical cut in the cigar 82. Such a conical cut is approximately 40% larger in surface area than the conventional planar cuts. For example, a planar cut yields a generally circular surface area that is represented by the equation:

$$A=pi*r^2, \text{ where r is the radius of the cigar.}$$

On the other hand, a conical cut yields a generally conical surface area that is represented by the equation:

$$A=pi*r*\text{sqrt}(r^2+h^2)$$

where r is the radius of the base of the bit or cone that is cut into the cigar 82, and h is the height of the bit or cone. Thus, assuming that the radius is 3 and h is 3, then a planar cut will yield a surface area of:

$$A=pi*3^2=28.3$$

On the other hand, a conical cut will yield a surface area of:

$$A=pi*3*\text{sqrt}(3^2+3^2)=39.5$$

In addition, the present invention's use of a high revolution motor 22 with the cutting blade 24 allows for the cut to be executed at such high speeds that the cigar wrapper is minimally disturbed along its edges, thereby minimizing possible tears.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A cigar cutter, comprising:

a housing;

a cutting platform provided on the housing;

a receiving well formed in the cutting platform for receiving one end of a cigar;

a motor retained inside the housing;

a switch that is operatively coupled to the motor for turning the motor on and off;

a cutter carried on the motor and extending into the receiving well, the cutter having a lower portion and a conical upper tip, with three cutting surfaces defined by three cutting edges provided on the conical upper tip; and a sliding cover that slides in a reciprocal manner along the cutting platform, the sliding cover operatively coupled to the switch.

2. The device of claim 1, wherein the sliding cover assumes a first position which exposes the receiving well and a second position which completely covers the receiving well.

3. The device of claim 1, wherein the cutting platform has an opening, and wherein the switch extends through the opening to couple the sliding cover.

4. The device claim 3, wherein the sliding cover has two notches that define a space therebetween, with the switch retained inside the space.

5. The device of claim 1, further including a power source retained in the housing and coupled to the motor.

* * * * *